United States Patent [19]

Kwan

[11] Patent Number: 4,507,577

[45] Date of Patent: Mar. 26, 1985

[54] NTH ORDER FUNCTION CONVERTER

[75] Inventor: Stephen C. Kwan, Plano, Tex.

[73] Assignee: Texas Instruments Incorporated, Dallas, Tex.

[21] Appl. No.: 234,130

[22] Filed: Feb. 13, 1981

[51] Int. Cl.[3] ..... G06G 7/20

[52] U.S. Cl. ..... 307/494; 328/144

[58] Field of Search ..... 328/144, 145; 307/490, 307/494

[56] References Cited

U.S. PATENT DOCUMENTS

| | | | |
|---|---|---|---|
| 3,599,013 | 8/1971 | Cope | 328/144 |
| 3,712,977 | 1/1973 | Rice | 307/494 |
| 3,967,105 | 6/1976 | Harrington | 328/145 |
| 3,986,048 | 10/1976 | Okada | 328/144 |
| 4,375,038 | 2/1983 | Crosby | 328/144 |

*Primary Examiner*—John S. Heyman
*Assistant Examiner*—Timothy P. Callahan
*Attorney, Agent, or Firm*—Douglas A. Lashmit; N. Rhys Merrett; Melvin Sharp

[57] ABSTRACT

An analog circuit for implementing nonlinear operators such as an Nth-root extractor or an Nth-power operator. Two input currents yield one output current having the relationship $I_1 = I_k^{-n} I_2^{n+2}$, where n is a positive integer and $I_k$ is a gain setting current. When n=1 the circuit functions as a square root extractor or a squaring converter. The present circuit is readily implemented with bipolar technology and offers high speed performance and temperature stability without external compensation. Typical applications of the present circuit include RMS measurement, auto-correlation, power measurement and gain compression/expansion.

9 Claims, 5 Drawing Figures

NTH ORDER FUNCTION CONVERTER

BACKGROUND OF THE INVENTION

The present invention relates generally to analog electronic circuits and more particularly to a circuit for implementing nonlinear operators.

Various circuits are known in the prior art for performing Nth-order operations. One such device includes a log-converter, a gain stage (where the gain=k) and an antilog converter to provide the Kth-order function, such that the output $V_o$ is expressed as $$V_o=a(V_{in})^k.$$

In this case the gain K can be manipulated to yield either a power or a root. However, this method is very complex and requires a temperature compensating component in each converter. Typical circuits using this approach appear in a publication by National Semiconductor, Inc., entitled "Linear Applications", Vol. 1 (1973) at pages AN31-18,20. Another circuit at page AN31-15 of the above reference is a two quadrant multiplier wherein $$V_o=KV_xV_y.$$

However, this circuit is only useful for squaring and requires a thermistor for temperature compensation because it operates on the principle of modulating the $r_E$ term, which is equal to $KT/qI_E$ where $I_E$ is one of the inputs. Further, this circuit is not readily adaptable to yield the inverse function, i.e., the square root.

Yet another prior art approach utilizes the square-law characteristics of an MOS device to perform a squaring operation. This approach is extremely susceptible to temperature variation and the uniformity from device to device is generally poor because of the variation in threshold voltage $V_T$. Again, the inverse function is not possible.

It is a principal object of this invention to provide a versatile Nth-order function converter that is readily programmable to operate as either an Nth-root extractor or an Nth-power operator. Another object of this invention is to provide a high speed analog function converter using bipolar devices in current mode operation. Still another object is to provide an inherently temperature stable converter requiring no external compensation.

SUMMARY OF THE INVENTION

In accordance with the present invention, an Nth-order analog function converter is provided that is readily programmable for either root or power operations. The converter is implemented using bipolar technology operating in the current mode to provide high speed operation.

In one embodiment of the invention, two current sources $I_1$ and $I_2$ are each coupled to the collector of a bipolar transistor, the bases of the transistors being coupled together. One or the other of the transistors is selectively configured to operate as a diode by coupling its base to its collector. Depending upon whether the $I_2$ or the $I_1$ transistor is so connected, the converter will function as either a "power" or a "root" operator, respectively. The emitter of the $I_2$ transistor is coupled to a string of n transistors connected as diodes, each having its collector coupled to its base and its emitter coupled to the next transistor in the string. The emitter of the nth transistor is coupled to ground. The emitter of the $I_1$ transistor is coupled to the inverting input and the output of a buffer having a low offset, for example a differential amplifier having a gain of k=1, the non-inverting input of which is coupled to a third current source $I_k$. $I_k$ is also coupled to a second string of n transistors configured as described above, with the emitter of the nth transistor being coupled to ground. For n transistors in a string, and assuming a collector-base short on the $I_2$ transistor, the output current $I_1=I_k{}^{-n}\ I_2{}^{n+1}$. With a collector-base short on the $I_1$ transistor, the output current will be $I_2=I_k{}^{n/(n+1)}I_1{}^{1/(n+1)}$. It is readily apparent that for n=1, i.e., one transistor in each string, the circuit will function as either a squaring converter or a square root extractor.

In the present configuration, the difference between the base-emitter voltage of $I_1$ and $I_2$ transistors is equal to the difference between the voltage across each string of transistors. Therefore, the thermal voltage component, KT/q, is cancelled out and the converter is inherently temperature stable.

The converter is useful, for example, in such applications as RMS measurement, auto-correlation, power measurement and gain compression/expansion.

BRIEF DESCRIPTION OF THE DRAWINGS

The novel features believed characteristic of the invention are set forth in the appended claims. The invention itself, however, as well as further objects and advantages thereof, will be best understood by reference to the following detailed description when read in conjunction with the accompanying drawings, wherein:

DETAILED DESCRIPTION OF THE DRAWINGS

Figure 1:
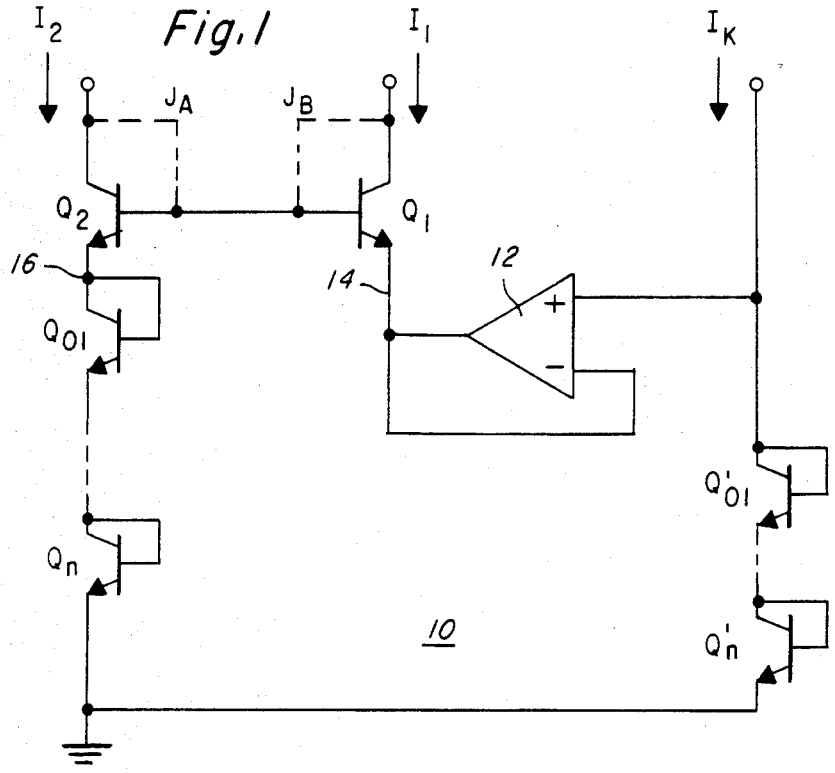
FIG. 1 is a schematic diagram of an (n+1) order function converter according to the present invention.

Referring now to the drawings, there is shown in FIG. 1 a schematic diagram of the general case of a function coverter 10 according to the present invention. Details of the current sources and power supply have been omitted from FIG. 1 so as to not unduly burden the description thereof. Further, it will be readily apparent to those skilled in the art that although NPN transistors have been utilized, PNP transistors may be substituted therefor with appropriate modifications to the respective polarities. A first current source $I_1$ is coupled to the collector of a transistor $Q_1$ having its emitter coupled to the output of an amplifier 12 configured to have non-inverting unity gain. A second current source $I_2$ is coupled to the collector of a transistor $Q_2$ having its base coupled to the base of transistor $Q_1$. The emitter of transistor $Q_2$ is coupled to the collector of a transistor $Q_{01}$ which is the first of a string of n series-connected transistors $Q_{01}\ldots Q_n$ each having its collector coupled to the emitter of the preceding transistor. The emitter of Qn, the last transistor in the string, is coupled to ground. The base of each transistor $Q_{01}\ldots$ Qn is coupled to its respective collector. In effect, each transistor in the string functions as a diode and therefore the string $Q_{01}\ldots$ Qn may be replaced by a string of n series-connected diodes. It is preferred, however, to use transistors with a collector-base short as shown in FIG. 1 because they have operating characteristics that more closely approximate those of an ideal diode.

A third current source $I_k$ is coupled to a string of diode-connection transistors $Q'_{01} \ldots Q'_n$ connected in the same configuration as the first string of transistors $Q_{01} \ldots Qn$ decribed above. The emitter of transistor $Q'_n$ is coupled to ground. This second diode string modulates the $I_k$ current source.

Amplifier 12, connected as a unity gain buffer, couples the voltage on the $Q'_{01}$ collector-base terminal to bias the emitter of $Q_1$, thus sinking the $Q_1$ emitter current $I_1$ without altering its voltage.

A pair of shorting means or jumpers $J_A$ and $J_B$, shown as dashed lines in FIG. 1, selectively provide a collector-base short on either $Q_1$ or $Q_2$ depending upon the operational configuration desired for converter 10. When $J_A$ is connected, $I_1$ is the output and the circuit operates as a power converter with $I_1$ proportional to $I_2^{(n+1)}$. Conversely, when $J_B$ is connected the circuit operates as a root extractor and $I_2$ is the output proportional to $I_1^{1/(n+1)}$. $I_K$ is used in both cases as a gain setting constant.

In operation, referring to FIG. 1, the voltage difference between points 14 and 16 is equivalent to the difference between the base-emitter voltages of transistors $Q_1$ and $Q_2$, i.e., $V_{BE1}-V_{BE2}$. This is also the difference in the voltage drop across the respective strings of transistors $Q_{01} \ldots Qn$ and $Q'_{01} \ldots Q'_n$. Since the transistors in each string are identical, the respective voltage drops may be expressed as $nV_{BE(Q01)}$ and $nV_{BE(Q'01)}$, and the difference is $n(V_{BEQ01}-v_{BEQ'01})$. The voltage difference at points 14 and 16 may then be expressed as $$V_{BE1}-V_{VE2}=n(V_{BEQ01}-V_{BEQ'01}.$$

Using the thermal voltage equivalent expression for the base-emitter voltage in terms of the collector currents $I_1$ and $I_2$, $$V_{BE1}-V_{BE2}=(KT/q)\ln(I_1/I_2).$$

Similarly, the $Q_{01}$ and $Q'_{01}$ base-emitter voltage difference may be expressed in terms of $I_2$ and $I_k$ as $$V_{BEQ01}-V_{BEQ'01}=(KT/q)\ln(I_2/I_k).$$

Substituting into the first equation $$(KT/q)\ln(I_1/I_2)=n(KT/q)\ln(I_2/I_k).$$

Removing the common terms (KT/q), $$\ln(I_1/I_2)=n\ln(I_2/I_k)=\ln[I_2/I_k)^n]$$

or, $$I_1/I_2=(I_2/I_k)^n.$$

In terms of $I_1$ this becomes $$I_1=\frac{1}{I_k^n}I_2^{n+1}$$

or, in terms of $I_2$, $$I_2=I_k^{n/n+1}(I_1)^{1/n+1}.$$

It should be noted that converter 10 is inherently insensitive to temperature since the last two equations are independent of the temperature term (KT/q) normally associated with diodes.

Assuming $I_k=1$, to obtain an output current $I_1$ equal to the nth power of an input current $I_2$, jumper $J_A$ must be connected and each string must contain (n−1) transistors, i.e., $Q_{01} \ldots Q_{n-1}$ and $Q'_{01} \ldots Q'_{n-1}$. Converter 10 is programmed as an nth root extractor by merely disconnecting $J_A$ and connecting $J_B$, whereupon the output current $I_2$ now equals the nth root of the input current $I_1$, again assuming $I_k=1$.

The accuracy of the present converter is directly related to the common mode current gain, or beta, of transistors $Q_1$ and $Q_2$. That is, the higher the beta, the more accurate the conversion. If a particularly high conversion accuracy is required, an emitter-follower stage can be included to drive the bases of $Q_1$ and $Q_2$ over a wide range of betas. For example, the collector of $Q_2$ can be connected to the base of an additional NPN transistor (not shown), whose emitter would be connected to the bases of $Q_1$ and $Q_2$, and whose collector would be connected to a $V_{CC}$ voltage supply.

Figure 2:
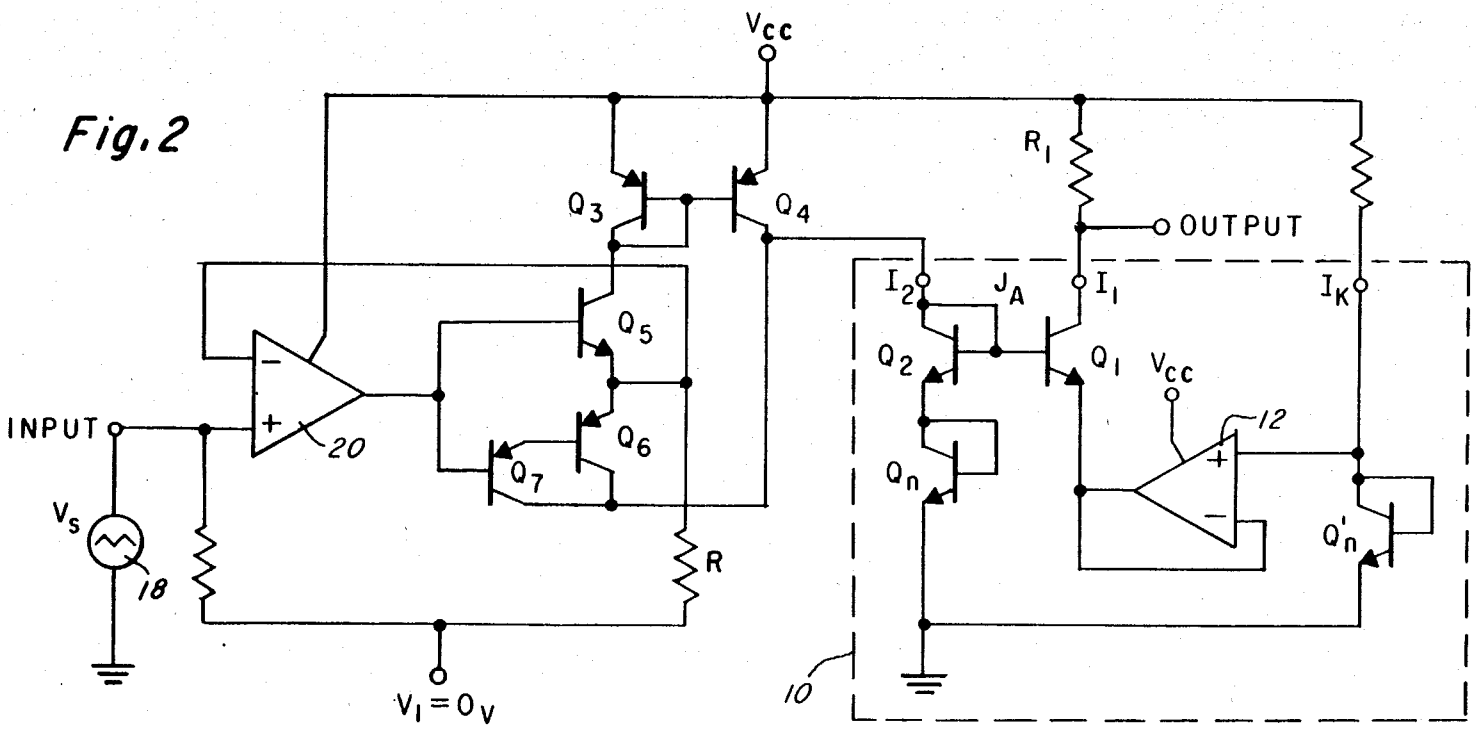
FIG. 2 is a schematic diagram of a squaring circuit including the converter of FIG. 1.

Referring now to FIG. 2, converter 10 is configured as a squaring converter. That is, $J_A$ is connected, there is one transistor in each string (n=1), and output $I_1$ is proportional to the square of input $I_2$. An A.C. voltage source 18 having a ramp voltage $V_s$ is shown as a typical input for which the square function is required. An amplifier 20 and transistors $Q_3$, $Q_4$, $Q_5$, $Q_6$, and $Q_7$ are used to convert the input voltage $V_s$ to a double-frequency absolute-valued current which is in turn coupled to input $I_2$ of converter 10. The squared output is then obtained as a current $I_1$.

Figure 3:
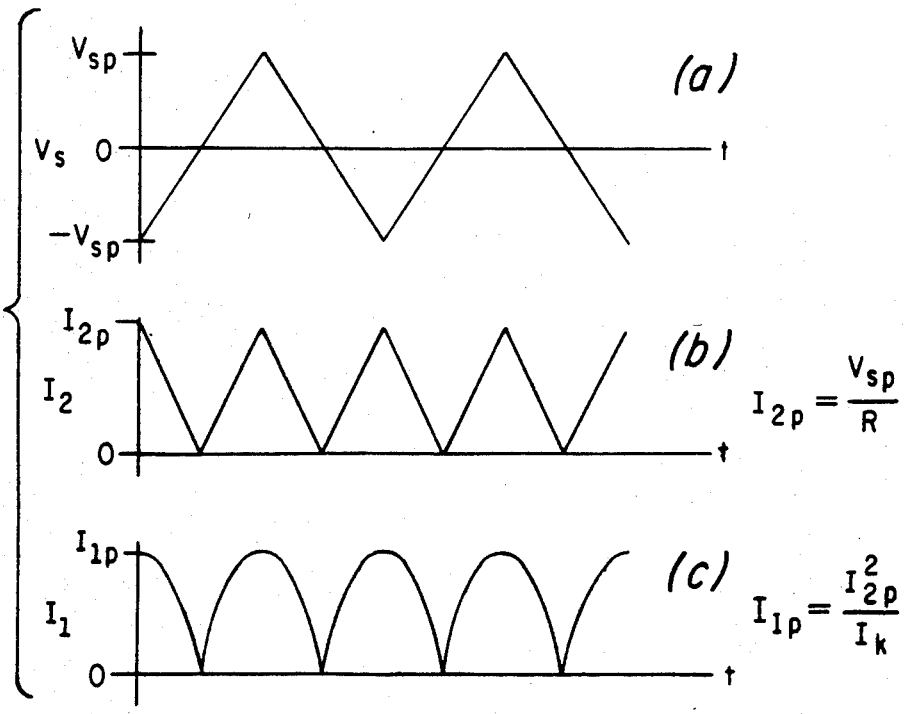
FIGS. 3*a*–3*c* are graphical representations illustrating the relationship of the input voltage to the output current in the circuit of FIG. 2.

By way of illustration, referring to FIG. 3*a*, a symmetrical sawtooth voltage signal $V_S$ applied to the input of the circuit of FIG. 2 has a positive voltage peak $V_{SP}$ and a negative voltage peak $-V_{SP}$. Transistors $Q_3$–$Q_7$ form a frequency doubling current source with $Q_5$ and $Q_6$ conducting on alternate half-cycles of the input signal $V_S$. The $Q_4$ collector current $I_2$, shown in FIG. 3*b*, is also the input current to converter 10.

The input voltage $V_S$, and the converter 10 input current $I_2$, may be expressed by a linear equation. Since the output current $I_1$ is related to the square of the input current $I_2$ as explained above, the converter output waveform is in this example a series of parabolas as shown in FIG. 3*c*. The voltage at the output of converter 10 is thus:

$$V_{out}=V_{CC}-I_1R_1.$$

In addition to the programmability of the converter of FIG. 1 for power or root functions by the connection of $J_A$ or $J_B$, the circuit may also be programmed for any root or power up to n+1 by shorting the appropriate transistor in each string to ground. For example, if the cube root were desired, $J_B$ would be connected and a short to ground would be connected at the emitter of the second transistor in each string, i.e., $Q_{02}$ and $Q'_{02}$.

The present converter is readily adaptable to any number of applications. For example, the combination of a square and a square root converter could be utilized in an RMS or a power measuring application. Or, by applying the square-converted output current to a summing amplifier for integration a particular auto-correlation function could be achieved. Various other embodiments and modifications will be apparent to those skilled in the art in light of the above disclosure. Therefore, it is to be understood that modifications to the details thereof may be made without departing from the spirit and scope of the invention.

What is claimed is:

1. A programmable function converter comprising:

a first plurality of N series-connected diode means;

a second plurality of N series-connected diode means wherein the last diode means of said second plurality of diode means is coupled to the last diode means of said first plurality of diode means and to a common voltage point;

a buffer means having inverting and non-inverting inputs and an output wherein said non-inverting input is coupled to said second plurality of diode means and said inverting input is coupled to said output;

first means for coupling a first current source to said buffer means;

second means for coupling a second current source to said first plurality of diode means, said second means also being coupled to said first means;

a third current source coupled to said non-inverting input of said buffer means; and third means for selectively coupling said first current source to said second coupling means or said second current source to said first coupling means, whereby said first current source is equal to the product of the (N+1)th power of said second current source and the (−N)th power of said third current source when said second current source is coupled to said first coupling means, and whereby said second current source is equal to the (N+1)th root of the product of said first current source and the Nth power of said third current source when said first current source is coupled to said second coupling means.

2. The function converter of claim 1, wherein each of said diode means in said first and second plurality of diode means comprises a bipolar transistor having its base coupled to its collector, the emitter of each transistor being coupled to the collector of the next transistor in succession.

3. The function converter of claim 2, wherein:

said first coupling means comprises a bipolar transistor having its collector coupled to said first current source and its emitter coupled to said buffer means output; and said second coupling means comprises a bipolar transistor having its collector coupled to said second current source, its emitter coupled to the collector of the first transistor in said first plurality of diode means, and its base coupled to the base of said first coupling transistor.

4. The function converter of claim 3, wherein said third coupling means comprises means for selectively placing a collector-base short on either said first coupling transistor or said second coupling transistor.

5. A function converter wherein a first current source is equal to the product of the (N+1)th power of a second current source and the (−N)th power of a third current source, comprising:

input diode means coupled to said second current source;

a first plurality of N series-connected diode means wherein said input diode means is coupled to the first diode means in said first plurality of diode means and the last diode means is coupled to a common voltage point;

a second plurality of N series-connected diode means wherein said third current source is coupled to the first diode means in said second plurality of diode means and the last diode means is coupled to said common voltage point;

an output transistor having its base coupled to said input diode means, said first current source being taken from the collector of said output transistor; and buffer means having inverting and non-inverting inputs and an output, wherein said non-inverting input is coupled to said first diode means in said second plurality of diode means, and said inverting input and said buffer means output are coupled to the emitter of said output transistor.

6. A function converter wherein the (N+1)th root of the product of a first current source and the Nth power of a third current source is equal to a second current source, comprising:

an input diode means coupled to said first current source;

buffer means having inverting and non-inverting inputs and an output wherein said inverting input and said buffer means output are coupled to said input diode means, and said non-inverting input is coupled to said third current source;

an output transistor having its base coupled to said input diode means and said first current source, said second current source being taken from the collector of said output transistor;

a first plurality of N series-connected diode means wherein the first diode means in said first plurality of diode means is coupled to the emitter of said output transistor and the last diode means in said first plurality of diode means is coupled to a common voltage point; and a second plurality of N series-connected diode means wherein the first diode means of said second plurality of diode means is coupled to the non-inverting input of said buffer means and the last diode means is coupled to said common voltage point.

7. The function converter of claim 5 or 6, wherein each of said diode means in said first and second plurality of diode means comprises a bipolar transistor having its base coupled to its collector, the emitter of each transistor being coupled to the collector of the next transistor in succession.

8. The function converter of claim 4 wherein said buffer means comprises an amplifier.

9. The function converter of claim 7 wherein said buffer means comprises an amplifier.

* * * * *